US007041006B2

(12) United States Patent
Bissonnette et al.

(10) Patent No.: US 7,041,006 B2
(45) **Date of Patent: *May 9, 2006**

(54) GOLF BALLS INCLUDING SOLUTION BLENDED POLYMERIC COMPOSITE AND METHOD OF MAKING SAME

(75) Inventors: Laurent C. Bissonnette, Portsmouth, RI (US); Roman D. Halko, Chula Vista, CA (US); David A. Bulpett, Boston, MA (US); Michael P. Mallamaci, North Canton, OH (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/801,530

(22) Filed: Mar. 17, 2004

(65) Prior Publication Data

US 2004/0176187 A1 Sep. 9, 2004

Related U.S. Application Data

(60) Division of application No. 09/923,407, filed on Aug. 8, 2001, now Pat. No. 6,710,114, which is a continuation-in-part of application No. 09/741,053, filed on Dec. 21, 2000, now Pat. No. 6,555,627.

(51) Int. Cl.
*A63B 37/00* (2006.01)

(52) U.S. Cl. ..... 473/351

(58) Field of Classification Search ..... 473/351, 473/377, 373, 374

See application file for complete search history.

(56) References Cited

U.S. PATENT DOCUMENTS

| | | | | |
|---|---|---|---|---|
| 3,213,160 A | | 10/1965 | Crouch | 260/894 |
| 3,238,156 A | | 3/1966 | Kohrn | |
| 3,666,272 A | * | 5/1972 | Walker et al. | 473/372 |
| 3,883,145 A | * | 5/1975 | Cox et al. | 473/372 |
| 3,896,102 A | | 7/1975 | Naylor | 260/94.3 |
| 3,903,019 A | * | 9/1975 | Hargis et al. | 502/154 |
| 3,926,933 A | | 12/1975 | Naylor | 260/94.3 |
| 3,974,238 A | | 8/1976 | Schweiker et al. | 260/879 |
| 4,020,007 A | | 4/1977 | Naylor | 252/429 B |
| 4,020,008 A | | 4/1977 | Naylor | 252/429 B |
| 4,020,115 A | | 4/1977 | Hargis et al. | 260/632 A |
| 4,266,772 A | | 5/1981 | Martin et al. | 273/218 |
| 4,436,857 A | | 3/1984 | Kuan et al. | 524/260 |
| 4,625,964 A | | 12/1986 | Yamada | 273/62 |
| 4,650,193 A | | 3/1987 | Molitor et al. | 273/228 |
| 4,683,257 A | | 7/1987 | Kakiuchi et al. | 524/432 |
| 4,688,801 A | | 8/1987 | Reiter | 273/218 |

(Continued)

FOREIGN PATENT DOCUMENTS

AU A-28623/97 1/1996

(Continued)

OTHER PUBLICATIONS

Encyclopedia of Polymer Science and Engineering, vol. 12, Polyesters to Polypeptide Synthesis, pp. 84-86.

(Continued)

*Primary Examiner*—Raeann Gorden
(74) *Attorney, Agent, or Firm*—Swidler Berlin LLP

(57) ABSTRACT

Golf balls having a portion or layer formed from a polymeric composite that preferably includes at least two polymers with distinct microstructures. In particular, the balls can include a polybutadiene having at least about 80 percent cis-isomer polybutadiene blended with a polybutadiene having at least about 50 percent trans-isomer polybutadiene. Methods of preparing such golf balls are also recited.

21 Claims, 1 Drawing Sheet

U.S. PATENT DOCUMENTS

| | | | | |
|---|---|---|---|---|
| 4,714,253 | A | 12/1987 | Nakahara et al. | 273/228 |
| 4,781,383 | A | 11/1988 | Kamada et al. | 273/228 |
| 4,840,381 | A | 6/1989 | Ihara et al. | 273/232 |
| 4,848,770 | A | 7/1989 | Shama | 273/228 |
| 4,863,167 | A | 9/1989 | Matsuki et al. | 273/62 |
| 4,919,434 | A | 4/1990 | Saito | 273/235 R |
| 4,929,678 | A | 5/1990 | Hamada et al. | 525/193 |
| 4,931,376 | A | 6/1990 | Ikematsu et al. | 526/164 |
| 4,955,613 | A | 9/1990 | Gendreau et al. | 273/218 |
| 4,971,329 | A | 11/1990 | Llort et al. | 273/218 |
| 4,979,746 | A | 12/1990 | Gentiluomo | 273/220 |
| 5,002,281 | A | 3/1991 | Nakahara et al. | 273/220 |
| 5,026,067 | A | 6/1991 | Gentiluomo | 273/220 |
| 5,048,838 | A | 9/1991 | Chikaraishi et al. | 273/228 |
| 5,072,944 | A | 12/1991 | Nakahara et al. | 273/220 |
| 5,082,285 | A * | 1/1992 | Hamada et al. | 473/372 |
| 5,141,233 | A | 8/1992 | Yuki et al. | 273/218 |
| 5,150,905 | A | 9/1992 | Yuki et al. | 273/218 |
| 5,173,461 | A * | 12/1992 | Absil et al. | 502/62 |
| 5,184,828 | A | 2/1993 | Kim et al. | 273/228 |
| 5,253,871 | A | 10/1993 | Viollaz | 273/228 |
| 5,255,922 | A | 10/1993 | Proudfit | 273/235 R |
| 5,273,287 | A | 12/1993 | Molitor et al. | 273/232 |
| 5,314,187 | A | 5/1994 | Proudfit | 273/235 R |
| 5,387,637 | A | 2/1995 | Sullivan | 524/493 |
| 5,407,998 | A | 4/1995 | Horiuchi et al. | 525/133 |
| 5,439,227 | A | 8/1995 | Egashira et al. | 273/228 |
| 5,482,285 | A | 1/1996 | Yabuki et al. | 273/228 |
| 5,490,674 | A | 2/1996 | Hamada et al. | 273/228 |
| 5,538,794 | A | 7/1996 | Cadorniga et al. | 428/407 |
| 5,553,852 | A | 9/1996 | Higuchi et al. | 473/373 |
| 5,556,098 | A | 9/1996 | Higuchi et al. | 473/373 |
| 5,601,502 | A | 2/1997 | Hiraoka et al. | 473/373 |
| 5,681,898 | A | 10/1997 | Pocklington | 525/193 |
| 5,683,312 | A | 11/1997 | Boehm et al. | 473/354 |
| 5,688,191 | A | 11/1997 | Cavallaro et al. | 473/373 |
| 5,738,597 | A | 4/1998 | Sullivan et al. | 473/377 |
| 5,753,761 | A | 5/1998 | Sandstrom et al. | 525/236 |
| 5,833,553 | A | 11/1998 | Sullivan et al. | 473/374 |
| 5,861,465 | A | 1/1999 | Hamada et al. | 525/332.6 |
| 5,958,638 | A | 9/1999 | Katayama et al. | 430/65 |
| 6,018,007 | A | 1/2000 | Lynch | 526/164 |
| 6,036,907 | A | 3/2000 | Tanaka et al. | 264/250 |
| 6,056,842 | A | 5/2000 | Dalton et al. | 156/243 |
| 6,093,357 | A | 7/2000 | Bissonnette et al. | 264/248 |
| 6,130,295 | A | 10/2000 | Yokota | 525/221 |
| 6,162,135 | A | 12/2000 | Bulpett et al. | 473/373 |
| 6,258,302 | B1 | 7/2001 | Nesbitt | 264/40.1 |
| 6,486,258 | B1 * | 11/2002 | Noguchi et al. | 525/191 |
| 6,710,114 | B1 * | 3/2004 | Bissonnette et al. | 524/493 |

FOREIGN PATENT DOCUMENTS

| | | |
|---|---|---|
| GB | 1026254 | 4/1966 |
| GB | 613700 | 9/1994 |
| GB | 2 299 518 A | 10/1996 |
| GB | 2 300 574 A | 11/1996 |
| GB | 2 302 035 A | 1/1997 |
| GB | 2 302 037 A | 1/1997 |
| JP | 51-49840 | 4/1976 |
| JP | 60-241463 | 11/1985 |
| JP | 64-80377 | 3/1989 |
| JP | 03-106380 | 5/1991 |

OTHER PUBLICATIONS

Hans-Georg Elias; Macromolecules 2 Synthesis, Materials, and Technology; Second Edition, 1984, p. 900.

The Condensed Chemical Dictionary, Tenth Edition, 1981, p. 902.

* cited by examiner

GOLF BALLS INCLUDING SOLUTION BLENDED POLYMERIC COMPOSITE AND METHOD OF MAKING SAME

CROSS-REFERENCE TO RELATED APPLICATIONS

This application is a divisional of U.S. patent application Ser. No. 09/923,407, filed Aug. 8, 2001 now U.S. Pat. No. 6,710,114, which is a continuation-in-part of U.S. patent application Ser. No. 09/741,053, filed Dec. 21, 2000, now U.S. Pat. No. 6,555,627. The priority applications are incorporated herein in their entirety by express reference thereto.

FIELD OF THE INVENTION

The present invention relates to golf balls having a portion or layer formed from a polymeric composite that preferably includes at least two polymers with distinct microstructures. In particular, the balls can include a polybutadiene having at least about 80 percent cis-isomer polybutadiene blended with a polybutadiene having at least about 50 percent trans-isomer polybutadiene. Methods of preparing such golf balls are also recited.

BACKGROUND OF THE INVENTION

Multi-layer golf balls contain a core, which may include one or more layers of solid material or one or more layers of solid material encompassing a fluid therein, and a cover. Optionally, an elastic winding may also be used to form a layer surrounding the center to provide certain playing characteristics. Such balls are known as "wound" balls. The multi-layer golf balls discussed herein include a core and a cover. The terms "core" or "ball core," as used herein, include a center having one or more layers and an intermediate layer formed of one or more layers. The terms "center" or "ball center," as used herein, include a solid and/or fluid mass around which an intermediate layer and a cover are disposed. The intermediate layer is disposed between the center and the cover, typically in concentric fashion, with the cover being the outermost portion of the ball.

A variety of golf ball compositions are known and used in various methods of manufacture. Unfortunately, these compositions and methods tend to produce balls that do not consistently achieve a symmetrical core. See, for example, the discussion in U.S. Pat. No. 6,056,842, which illustrates the poor centering that occurs in conventionally formed golf balls. Multi-layer ball production has been plagued by center portions that become off-centered during the manufacture of such balls. Off-center golf balls are a hindrance to many players, particularly those able to achieve great control using a symmetrical ball. This lack of symmetry is now believed to be caused, at least in part, by the materials and methods conventionally used in forming multi-layer golf balls. Compositions typically including greater than 40 percent cis-1, 4-polybutadiene isomer are often used in forming golf ball cores, or a portion thereof. Unfortunately, many cis-polybutadiene materials are fairly soft prior to crosslinking, which can lead to the off-centering problems noted above. A number of references disclosing various cis-polybutadiene materials are discussed below.

U.S. Pat. Nos. 3,896,102; 3,926,933; 4,020,007; and 4,020,008 disclose a 1,3-butadiene component and a method and catalyst for preparing trans-polybutadiene, and that it is well known that increasing content of trans-polybutadiene is more resinous and produces a more elastic, tough, crystalline, thermoplastic solid. The '933 and '008 patents further disclose that trans-polybutadiene is resistant to attack by ozone and other chemical agents, and is typically used in insulation, battery cases, and golf ball covers.

U.S. Pat. No. 4,020,115 discloses the preparation of homopolymers and random copolymers of butadiene with styrene and/or isoprene that include butadiene units having a low vinyl content of not over 12 percent and a trans-polybutadiene structure of from about 70 to 81 percent. These polymers are disclosed to have broad molecular weight distribution, as well as tack and green-strength desired for manufacturing tires. A variety of trans-polybutadiene and vinyl-polybutadiene materials are also disclosed with the catalysts used for the preparation thereof.

U.S. Pat. No. 4,919,434 discloses a two-piece golf ball having a solid core of more than 40% cis-1,4-polybutadiene isomer and a cover having an inner layer of 0.1 to 2 mm thickness and an outer layer of 0.1 to 1.5 mm thickness. The inner layer is a thermoplastic resin, such as an ionomer, polyester elastomer, polyamide elastomer, thermoplastic urethane elastomer, propylene-butadiene copolymer, 1,2-polybutadiene, polybutene-1, and styrene-butadiene block copolymer, either individually or in combination.

U.S. Pat. No. 4,929,678 discloses a rubber composition for golf balls including at least 40 percent by weight polybutadiene rubber with a Mooney viscosity of 45 to 90 and a cis-bond content of at least 80 percent, a co-crosslinking agent, and a peroxide. These polymers are disclosed to have a dispersity of between 4.0 to 8.0, which is a ratio of weight average molecular weight to number average molecular weight.

U.S. Pat. No. 4,931,376 discloses butadiene polymers and copolymers with another conjugated diene having at least 80 percent butadiene by weight; 60 to 98 percent trans-polybutadiene linkages; a molecular weight distribution of 1.1 to 4.0; melting temperature of 40° C. to 130°C.; and a content of insolubles in boiling cyclohexane of 1% or less, as well as processes for making the same. Weight average molecular weights of 30,000 to 300,000 and trans-polybutadiene contents greater than about 30 percent are preferred. These materials are disclosed for use in golf ball covers, splint or gyps material, and the like.

U.S. Pat. No. 4,955,613 discloses golf balls made from two polybutadienes, each having a Mooney viscosity below about 50 and a cis-polybutadiene isomer content of greater than about 40 percent, more preferably greater than about 90 percent, and catalysts for preparing the polybutadienes.

U.S. Pat. No. 4,971,329 discloses solid golf balls made from polybutadiene mixtures of about 99.5 to 95 weight percent cis-1,4-polybutadiene and about 0.5 to 5 weight percent vinyl-1,2-polybutadiene. The cis-polybutadiene is made by blending from about 80 percent to 100 percent by weight of cis-polybutadiene with a cis-content of 95 percent and about 0 weight percent to 20 weight percent of cis-polybutadiene with a cis-content of about 98 percent.

U.S. Pat. No. 5,553,852 discloses three-piece solid golf balls having a center core, intermediate layer, and cover. The center core is prepared with a 1,4-polybutadiene containing more than 90% cis-polybutadiene isomer for high repulsion, co-crosslinking agent(s), peroxide, and other additives.

U.S. Pat. No. 5,833,553 discloses core compositions including polybutadiene, natural rubber, metallocene catalyzed polyolefins, polyurethanes, and other thermoplastic or thermoset elastomers, and mixtures thereof having a broad molecular weight range of 50,000 to 500,000, preferably from 100,000 to 500,000. Polybutadiene with a high cis-content is noted as being preferred.

U.S. Pat. No. 5,861,465 discloses thread rubber for wound golf balls having rubber component obtained by vulcanizing rubber composition including rubber selected from natural rubber, synthetic high-cis-polyisoprene rubber, and mixtures with at least one specific diaryl disulfide, a vulcanizing agent, and an antioxidant.

U.S. Pat. No. 6,018,007 discloses the preparation of trans-polybutadiene and other polymers and copolymers having trans configuration in the conjugated diene monomer contributed units with improved catalyst systems. The resulting polymers are rubbery, except those with high trans content, and may be vulcanized by well known methods and incorporated in tires, general rubber goods, and plastics materials.

U.S. Pat. No. 6,130,295 discloses a two-piece golf ball having an unvulcanized cover that includes a mixture of ionomer and polybutadiene having a trans-isomer content of at least 60 percent.

It is desirable to reduce the off-centering problem and manufacturing inconsistencies found in many conventional golf balls, although little notice has been taken of this important part of golf ball manufacture until recently. In part, many materials are difficult to work with before they have been crosslinked. The polymers typically used in the core, particularly in intermediate layers or shells, tend to have a memory that urges the polymer back to its earlier or original shape, which necessitates rapid compression molding to crosslink the polymer as soon as the shells are formed.

It is also understood that there has been great difficulty in the art when attempting to blend certain polymer materials having different microstructures, e.g., polybutadiene and polyisoprene. Thus, it is desired to find an improved composition and method for providing such composition, for use in manufacturing golf balls that reduces or avoids the disadvantages present when using conventional materials for golf balls.

SUMMARY OF THE INVENTION

The invention relates to a golf ball including a polymeric composite which comprises at least one polybutadiene. In a first embodiment, the polymeric composite is formed from a material including at least two polymers, for example, polybutadiene and polyisoprene. In a second embodiment, the polymeric composite is formed from a material including at least one polybutadiene and a plurality of nanoparticles. In one embodiment, the polymeric composite has less than about 5 percent vinyl-isomer content in the polybutadiene. In a preferred embodiment, the polymeric composite has less than about 3 percent vinyl-isomer content in the polybutadiene. In another embodiment, the polymeric composite has at least about 20 percent trans-isomer content in the polybutadiene. In one preferred embodiment, the polymeric composite has a molecular weight of at least about 200,000 and a polydispersity of less than about 3. To achieve high resilience, it is preferred in one embodiment that each polymeric material in the polymer composite have a molecular weight of at least about 200,000 and a polydispersity of less than about 3. In an embodiment where processability improvements are more important, however, each polymer material preferably has a different molecular weight. In one such preferred embodiment, the difference in molecular weight is at least about 100,000.

In one preferred embodiment, the polymeric composite includes a plurality of nanoparticles having an average size of less than about 5000 nm. Nanoparticles are one possible method to alter the modulus of materials used to form one or more layers of a ball, as they permit adjustment of density, COR, and mixing time. In a preferred embodiment, the polymeric composite includes nanoparticles and a coupling agent. Preferred coupling agents include silanes, titanates, and sulfides. In one embodiment, the nanoparticles include silica.

In another embodiment, the golf ball includes at least two layers and the polymeric composite is disposed in at least one of the two layers. In another embodiment, the polymeric composite is disposed in a core of the golf ball. In yet another embodiment, the polymeric composite is disposed in a cover layer of the golf ball. The polymeric composite can also be disposed in an elastomeric thread that forms a layer in the golf ball, either alternatively or in addition to the above-noted embodiments.

In one embodiment, the polymeric composite comprises at least one polyisoprene polymer. In a preferred embodiment, the at least one polyisoprene polymer has a trans-isomer content of at least about 10 percent. One preferred embodiment includes a polymeric composite including a blend of the at least one polyisoprene polymer and at least one polybutadiene polymer in at least a portion of a golf ball.

In one embodiment, the effective modulus of a core including the crosslinked polymeric composite is less than about 110 MPa (~16,000 psi). In one alternate embodiment, the effective modulus of a core including the crosslinked polymeric composite is less than about 55 MPa (~8000 psi). In another embodiment, the coefficient of restitution of a core including the polymeric composite is greater than about 0.8. In yet another embodiment, the flexural modulus of an uncrosslinked compound including the polymeric composite is greater than about 3.5 MPa.

The invention also relates to a method of preparing the above-described golf ball by combining a first polybutadiene cement having at least about 50 percent trans-isomer content and a second polybutadiene cement having at least about 90 percent cis-isomer content to form a first mixture, evaporating at least substantially all of the solvent from the first mixture to obtain a polymeric composite, combining the polymeric composite with at least one crosslinking agent to obtain a second mixture, and forming the second mixture into at least a portion of the golf ball.

In one embodiment, the forming includes injection molding. In one embodiment, the first polybutadiene cement has been polymerized in the presence of a sufficient amount of cobalt-catalyst to increase the trans-isomer content of the polybutadiene. In another, preferably alternative, embodiment, at least one of the polybutadiene cements has been polymerized in the presence of a sufficient amount of nickel or neodymium catalyst to increase the molecular weight of the cement.

The invention also relates to a golf ball including a polymeric composite which includes a first polybutadiene having at least 90 percent cis-isomer, a second polybutadiene having at least 70 percent trans-isomer, and a plurality of nanoparticles, wherein the polymeric composite includes a polybutadiene having less than about 5 percent vinyl-isomer content. In one embodiment, the second polybutadiene has less than about 50 percent trans-isomer content.

The invention also relates to a golf ball where the flexural modulus of the uncrosslinked polymeric composite is greater than about 3.5 MPa.

BRIEF DESCRIPTION OF THE DRAWINGS

Further features and advantages of the invention can be ascertained from the following detailed description which is provided in connection with the attached drawings, wherein.

DEFINITIONS

Figure 1:
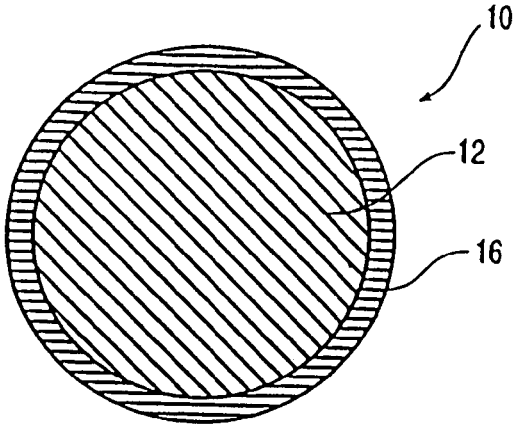
FIG. 1 illustrates a cross-sectional view of a two-piece golf ball having a cover and a core according to the invention.

The term "about," as used herein in connection with one or more numbers or numerical ranges, should be understood to refer to all such numbers, including all numbers in a range.

As used herein, the terms "Atti compression" and "compression" are defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. Compression values are dependent on the diameter of the article being measured. When the Atti Gauge is used to measure cores having a diameter of less than 1.680 inches, it should be understood that a metallic or other suitable shim is used to make the combined shim and measured object 1.680 inches in diameter.

As used herein, unless otherwise stated, the percent of cis-isomer 30 polybutadiene, also called the percent of cis-polybutadiene, reflects the amount of cis-isomer compared to the total number of polybutadiene isomers. The fraction is multiplied by 100 to obtain the percent. The percent of trans-isomer polybutadiene, also called the percent of trans-polybutadiene, reflects the amount of trans-isomers compared to the total number of polybutadiene isomers in the composition, with this number being multiplied by 100 to determine the percentage. The percent of vinyl-isomer is similarly defined.

As used herein, the term "cement" refers to a polymer in solution, such as in a solvent of hexane, toluene, or THF. Thus, a "cement blend" refers to at least two cements in solution.

As used herein, the term "coefficient of restitution" for golf balls is defined as the ratio of the rebound velocity to the inbound velocity when balls are fired into a massive rigid plate. The inbound velocity is understood to be 125 ft/s.

As used herein; the term "fluid" includes a liquid, a paste, a gel, a gas (such as air), or any combination thereof.

As used herein, the term "intermediate layer" refers to an optional part of a golf ball core that, when present, is disposed about the center and in turn has a cover disposed thereabout, optionally with one or more additional layers disposed therebetween. The intermediate layer portion of the ball may include one or more layers, each of which may be formed by assembling two "half-shells," "preps," "preforms" or the like about the center, typically followed by compression molding to form a spherical shell. The intermediate layer may also be formed in a single step injection molding process.

As used herein, the term "molecular weight" ($M_w$) is defined as the absolute weight average molecular weight unless otherwise specified.

As used herein, the term "parts per hundred", also known as "phr", is defined as the number of parts by weight of a particular component present in a mixture, relative to 100 parts by weight of the total polymer, such as polybutadiene. Mathematically, this can be expressed as the weight of an ingredient divided by the total weight of the polymer, multiplied by a factor of 100.

As used herein, the term "polydispersity" means $M_w/M_n$, where $M_n$ (the number average molecular weight)=Total Weight (Daltons)/Number of Molecules As used herein, the term "polymeric composite" refers to a blend of at least two cements, wherein substantially all of the solvent(s) has been removed, or to a single cement blended with a plurality of nanoparticles.

As used herein, "Shore D hardness" is determined according to ASTM D2240-00.

As used herein, "flexural modulus" is measured by ASTM D6272-98, Procedure B, about two weeks after preparing the test specimen for cover materials. For uncrosslinked core materials, this modification of Procedure B is unnecessary.

As used herein, "substantially all" of the solvent refers to an amount such that the remaining solvent will not materially affect the properties of the polymeric composite. In one embodiment, substantially all refers to at least about 90 percent of the solvent, preferably at least about 99 percent of the solvent, is removed.

DETAILED DESCRIPTION OF THE INVENTION

A new composition for one or more layers of a golf ball core, preferably for inclusion in at least one intermediate layer disposed about a center, and a method for manufacturing such golf ball cores has now been discovered. The invention permits advantageously improved symmetrical formation of the core in golf balls prepared in accordance with the present invention. The proposed compositions, for example, can facilitate injection molding of the uncrosslinked shells that can be used to prepare an intermediate layer and can permit automated assembly, each of which greatly reduces production costs and improves final golf ball accuracy and consistency.

Resilient polymer components, such as polybutadiene, typically have a "memory" that forces reshaped components to attempt to return to their original or previous shape. It has now been discovered that the use of certain types of polybutadiene components imparts reinforcement to the golf ball core portion being formed, such that the composition inhibits or avoids the usual problems common when conventional polymers relax to an earlier or original position that may result in formation of an off-center ball during further processing. The present invention prepares a material with this advantageous polybutadiene as discussed herein to help impart geometrical stability to the uncrosslinked material used to form the intermediate layer, at least in part by inhibiting shifting of the intermediate layer during assembly about the center.

In particular, the invention provides a polymer composite composition that facilitates golf ball manufacture. This polymer composite includes at least two polymers having distinct microstructures. In one preferred embodiment, a first polymer includes polybutadiene having a cis-isomer content of at least about 80 percent, preferably greater than about 90 percent and a second polymer includes polybutadiene having a trans-isomer content of at least about 70 percent, preferably greater than about 80 percent. In one embodiment, the trans-isomer content is at least about 90. The polymer composite as a whole preferably has a vinyl-isomer content of less than about 5 percent, preferably less than about 3 percent. In one preferred embodiment, the polymer composite has a vinyl-isomer content of less than about 1 percent. In another preferred embodiment, the polymer composite includes at least one polybutadiene and at least one polyisoprene.

The polymer composite is advantageously provided by solution mixing the at least two polymers, each of which could be separately polymerized using distinct polymerization processes. The solution blend and resultant polymer composite can also include one or more reinforcing agents. Reinforcing agents preferably include inorganic particles, such as nanoparticles. In particular, preferred nanoparticles include those that are silica-based or carbon-based. In one embodiment, the silica-based nanoparticles are more preferred. Inclusion of such optional, but preferred, nanoparticles can readily pass through the finest piping and filtering processes while avoiding any substantial effect on the viscosity of the polymeric blend. Moreover, increasing amounts of nanoparticles can advantageously correspondingly decrease the amount of crosslinking agent required to provide increased resilience.

The nanoparticles typically have an average size of about 0.01 nm to 5000 nm, preferably about 0.5 nm to 100 mn. In one preferred embodiment, the average nanoparticle size is about 1 nm to 50 run. The nanoparticles are typically dispersed throughout the polymer content of the polymeric composite, preferably substantially uniformly dispersed. In one preferred embodiment, the nanoparticles are uniformly dispersed throughout the polymeric composite. Although any type of nanoparticle available to one of ordinary skill in the art can be included in the invention, the nanoparticles preferably include silica, ZnO, or both. The nanoparticles can be present in an amount up to about 40 weight percent of the polymeric composite. In one embodiment, the nanoparticles are present in an amount from about 0.1 to 20 weight percent of the composite. In another embodiment, the nanoparticles are present in an amount from about 0.01 to 1 weight percent. Coupling agents may be added to the polymeric composite to facilitate bonding between the polymer and particles. Preferred coupling agents include silanes, titanates, and sulfides, or a combination thereof.

Without being bound by theory, it is believed that polymerization of polybutadiene polymers in solution using a wide variety of catalysts, including neodymium-, cobalt-, lithium-, titanium-, barium-, or nickel-based compounds, or a combination thereof, along with certain other catalysts, solvents, and modifiers, can be used to produce alternative microstructures according to the invention. A sufficient amount of catalyst is used to facilitate polymerization of the polymer in solution.

For example, a cobalt catalyst can be used to produce a polybutadiene polymer having a trans-isomer content of greater than about 75 percent with a moderate amount of branching, while a nickel catalyst would produce a highly linear polybutadiene polymer having greater than about 96 percent cis-isomer content. In one embodiment, at least one catalyst can be used to polymerize each polymer in solution. For example, a nickel-based catalyst can be used to form a first polymeric cement and a cobalt-based catalyst can be used to form a second polymeric cement according to the invention. The two polymers may then be combined according to the invention while still in solution after polymerization to form a cement blend. The blend can then be stripped of solvent. It should be understood that complete stripping of solvent is not required, as small amounts of remaining solvent can be stripped subsequently through evaporation or during further processing. The cobalt-polymerized polybutadiene alone would be moderately resilient and possess a high degree of crystallinity at room temperature, making the polymer rigid, while the nickel-polymerized polybutadiene would be highly resilient. The combination provides a highly useful material for use in forming one or more portions of a golf ball. On the contrary, conventional blending of a high amount of a cis-isomer polybutadiene and a high amount of a trans-isomer polybutadiene may require such polybutadiene to be preheated to melt crystalline domains prior to internal mixing. Conventional blending techniques result in discrete, relatively large domains of discrete polymer.

In another embodiment, a cement including a polymer can be combined with a plurality of nanoparticles to form a polymeric composite according to the invention. The nanoparticles are preferably added to the cement, and then at least substantially all of the solvent is stripped from the cement to form the polymeric composite of a polymer and a plurality of nanoparticles. One embodiment of the invention includes a single polybutadiene and a plurality of nanoparticles to form a polymeric composite. In other embodiments, additional polymers are included, such as a composite of polybutadiene, polyisoprene, nanoparticles, coupling agents, or a combination thereof.

The combination of the polymers while in solution advantageously facilitates and improves the mixing of the at least two polymers, providing properties unobtainable using conventional mixing or polymerization techniques. Combining the nickel and cobalt polybutadiene materials noted above by conventional rubber processing techniques, such as internal mixers, roll mills, or twin screw extruders, is difficult and tends to produce poor results with distinct polymeric regimes. The formation of the polymer composite in solution forms a polymer that is rigid, yet formable at room temperature, and is highly resilient when used in a golf ball. The formability permits the formation of shells, such as hemispherical shells, that facilitate the fabrication of multi-layer golf balls.

In another embodiment, the polymeric composite of the invention can provide a "bale" of polybutadiene or other blended polymeric material for direct use in golf ball production. Certain polymeric materials, such as polybutadiene, are often provided in the form of "bales" of material, and these conventionally need to be blended with other materials. According to the present invention, the polymeric composite including at least two polymer materials can be advantageously formed into bales of the composite material. This can avoid the need to provide separate bales of material for combination and also can facilitate or avoid the difficulties that occur when conventionally mixing a high trans-isomer content polybutadiene rubber with polyisoprene or polybutadiene. In one preferred embodiment, a bale of polymeric composite can be provided having at least about 20 percent trans-isomer content and less than about 5 percent vinyl-isomer polybutadiene content. Such blended bales typically have desirable cold flow attributes, high resilient at low modulus when compounded and formed into a golf ball, are rigid and formable in the uncrosslinked state, and facilitate incorporation of such polymeric composites into a portion of a golf ball. Also, such blended polymeric composite materials require less processing and are more resilient (as measured by COR) than a comparable blend of polybutadiene and trans-polyisoprene, particularly when used to form an intermediate layer of a golf ball surrounding a center. Further, the inclusion of the optional but preferred nanoparticles can reduce or avoid the amount of crosslinking agent needed for crosslinking.

The polymeric composite materials can be used in any application for which blended materials, such as thermoplastic/thermoset blends, are required. Examples include tires, hoses, and the like. A preferred use of the polymeric composites of the invention is for use in forming at least a portion of a golf ball layer. Readily available equipment, such as pipes and mixing tanks, are required to convert a conventional rubber processing setup to one capable of processing polymeric composites according to the invention. Thus, the invention advantageously permits a vast array of materials to be prepared for use in a golf ball with minimal additional cost, which would be incurred if conventional blending techniques were required to be employed. Moreover, the composite polymer is easily processed in rubber injection molding equipment. For example, a rigid composite polymer can be formed as a "tape" for use in feeding conventional injection molding machines. The "tape" preform can be produced using a conventional extruder technology and, for example, a bale of polymeric composite formed according to the invention. The composite polymer, preferably having room temperature rigidity, produces a "tape" with low tack and high green strength, which are highly desirable features for injection molding preforms. In one embodiment, rigidity refers to a flexural modulus of an uncrosslinked polymeric composite of at least about 3.5 MPa.

Although the core of a ball prepared according to the invention may be only one layer, it is preferred that the core include a center and at least one intermediate layer disposed thereabout. The core and center of the ball are preferably spherical, may be solid or fluid-filled, and when the core has multiple layers the center is generally about 0.5 inches to 1.5 inches, preferably about 0.8 inches to 1.3 inches, and more preferably about 1 to 1.2 inches in diameter. It is envisioned that a tensioned elastomeric thread or strip may be wound around the center, either before or after additional intermediate layers may be added.

The intermediate layer could have a thickness of about 0.1 to 0.6 inches, and in one embodiment it could have a thickness of about 0.15 to 0.35 inches, more preferably about 0.2 to 0.3 inches, and the intermediate layer may of course include one or more intermediate layers. The entire core, including the center and intermediate layer if desired, should have a diameter of about 1.25 to 1.65 inches, preferably 1.38 to 1.6 inches, where twice the intermediate layer thickness is included in the core diameter since the intermediate layer encloses the center. The diameter of the intermediate layer corresponding to a particular center, and of the cover formed around the intermediate layer and center, may be adjusted according to the diameter of the center to provide a golf ball formed according to the invention with the overall minimum diameter required by the USGA once the cover is applied. The intermediate layer, when included, should be thick enough to form the core when molded over the center. The minimum intermediate layer thickness is readily determined by one of ordinary skill in the art, and may depend upon the specific materials used to form the intermediate layer as well as the thickness of the center, the cover, and the presence of other intermediate layer layers. One example of a preferred ball center size according to the invention is a center having a diameter of 1.08 inches and an intermediate layer having a thickness of 0.25 inches to provide a core having a 1.58 inch diameter. A cover of 0.05 inches thickness is then applied to provide a golf ball having a diameter of 1.68 inches. The golf balls including the controlled-isomer polybutadiene typically range in size from about 1.5 to 1.8 inches, preferably about 1.6 to 1.8 inches, and more preferably from about 1.64 to 1.74 inches. Most preferably, the golf ball will comply with the USGA rules of golf.

It is now believed that minimizing the gross number of polymeric chain ends in a golf ball compound tends to increase resilience. As molecular weight increases, however, mixing characteristics are adversely affected due to the high polymer viscosity. One way to reduce chain ends is by increasing the molecular weight average and providing a low polydispersity. Thus, prior to crosslinking, the polybutadiene component of the invention typically can have a polydispersity of no greater than about 4, preferably no greater than about 3, and more preferably no greater than about 2.5. In one preferred embodiment, the polydispersity is no greater than about 1.5.

The polybutadiene component of the invention typically has a high molecular weight, defined as being at least about 100,000, preferably from about 200,000 to 1,000,000. In one embodiment, the molecular weight is from about 230,000 to 750,000 and in another embodiment it is from about 275,000 to 700,000. In any embodiment where the vinyl-content is present in greater than about 10 percent, the molecular weight is preferably greater than about 200,000.

The molecular weight is measured as follows. Approximately 20 mg of polymer is dissolved in 10 mL of THF, which may take a few days at room temperature depending on the polymer's molecular weight and distribution. One liter of THF is filtered and degassed before being placed in an HPLC reservoir. The flow rate of the HPLC is set to 1 mL/min. through a Viscogel column. This non-shedding, mixed bed, column model $GMH_{HR}$-H, which has an ID of 7.8 mm and 300 mm long is available from Viscotek Corp. of Houston, Tex. The THF flow rate is set to 1 mL/min. for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment.

One hundred microliters of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein.

The polybutadiene component of the invention may be produced by any means available to those of ordinary skill in the art, preferably with a catalyst that results in a polybutadiene having at least 80 percent trans-content and a high molecular weight. A variety of literature is available to guide one of ordinary skill in the art in preparing suitable polybutadiene components for use in the invention, including U.S. Pat. Nos. 3,896,102; 3,926,933; 4,020,007; 4,020,008; 4,020,115; 4,931,376; and 6,018,007, each of which is hereby incorporated herein by express reference thereto. One preferred method of providing the controlled-isomer polybutadiene is by using a catalyst including cobalt, barium, nickel, neodymium, lithium, or titanium, or a combination thereof.

A method for improving the resilience of the polymeric composite or the controlled-isomer polybutadiene of the present invention is by converting a portion of the cis-polybutadiene isomers into trans-isomers to form a material from the conversion reaction of an amount of polybutadiene, a free radical source, and a cis-to-trans catalyst including at least one organosulfur component, inorganic sulfide component, an aromatic organometallic compound, a metal-organosulfur compound, elemental sulfur, a polymeric sulfur, or an aromatic organic compound. This conversion reaction is accomplished at a sufficient reaction temperature to form a polybutadiene reaction product which includes an amount of trans-polybutadiene greater than the amount of trans-polybutadiene present before the conversion reaction as disclosed in U.S. Pat. No. 6,162,135 or application Ser. Nos. 09/461,736, filed Dec. 16, 1999; 09/458,676, filed Dec. 10, 1999; or 09/461,421, filed Dec. 16, 1999. Each of these references is incorporated herein in its entirety by express reference thereto. For example, the definitions of these various cis-to-trans catalyst terms may be found described in one or more of these incorporated documents.

The golf ball may also include mixtures of polymeric composite and a wide variety of thermoplastic or thermoset materials to achieve desirable processing or performance characteristics. The term "polymer mixture" is used herein to mean polymers that are mechanically mixed after solvent stripping or extraction, such as a mixture of a polybutadiene component of the invention and one or more resilient polymers. Such materials can include conventional cis-polybutadiene polymers or other resilient or reinforcing polymers suitable for use with the polybutadiene component or polymeric composite of the invention. When preparing the ball core, such materials can include conventional cis-polybutadienes that typically contain greater than about 40 percent cis-content, polyisoprene, styrene-butadiene rubber, styrene-butadiene-styrene rubber, ethylene propylene-diene rubber (EPDM), mixtures thereof, and the like. The additional resilient polymer is preferably polyisoprene or conventional polybutadiene, more preferably conventional polybutadiene. One example of a suitable conventional cis-polybutadiene for inclusion in the material is CARIFLEX BR 1220, commercially available from H. MUEHLSTEIN & CO., INC. of Norwalk, Conn. The optional resilient polymer component has a high molecular weight average, defined as being at least about 50,000 to 1,000,000, preferably from about 150,000 to 750,000, and more preferably from about 200,000 to 400,000. CARIFLEX BR 1220 is believed to have a molecular weight average of about 372,000. Additional suitable polymer materials include: trans-polyisoprene, block copolymer ether/ester, acrylic polyol, polyethylene, polypropylene, polyethylene copolymer, ethylene-vinyl acetate copolymer, trans-polycyclooctenamer, trans-polybutadiene, and mixtures thereof. Particularly suitable reinforcing polymers include: HYTREL 3078, a block copolymer ether/ester commercially available from DuPont of Wilmington, Del.; FUREN 88, an 88 percent trans-content polybutadiene having an molecular weight of 175,000 from Asahi Chemicals of Yako, Kawasaki-iku, Kawasakishi, Japan; KURRARAY TP251, a trans-polyisoprene commercially available from KURRARAY CO.; LEVAPREN 700HV, an ethylene-vinyl acetate copolymer commercially available from Bayer-Rubber Division, Akron, Ohio; and VESTENAMER 8012, a trans-polycyclooctenamer commercially available from Huls America Inc. of Tallmadge, Ohio. Other suitable materials include VLMIs, such as ionomers of ethylene methacrylic acid butyl acrylate; ionomers such as the SURLYN® series, which are resins sold commercially by DuPont, or IOTEK® series, which is sold commercially by Exxon; maleic anhydride modified ethylene-vinyl acetate copolymers, such as the FUSABOND® series, which is commercially available from DuPont (for example, FUSABOND® 925); ethylene methacrylic/acrylic acid copolymers, such as those sold commercially by DuPont under the tradename NUCREL® (for example, NUCREL® 960). Any suitable combination of one or more of the above materials can be included in the polymer portion according to the invention.

The polymer portion of the material, which totals to "100 phr," preferably includes predominantly the controlled-isomer polybutadiene or polymeric composite of the invention. In one preferred embodiment, the polymer portion includes about 60 to 100 percent, and in a more preferred embodiment includes from about 70 to 100 percent of the controlled-isomer polybutadiene polymer or polymeric composite. "Predominant" or "predominantly" is used herein to mean greater than 50 percent.

When the uncrosslinked polymer material is used to form an intermediate layer, it should have a flexural modulus of greater than about 3.5 MPa, and preferably greater than about 7 MPa. The polybutadiene component or polymeric composite of the invention imparts a degree of rigidity to the shells sufficient to maintain the desired shape until the first mixture is crosslinked.

Suitable crosslinking agents include one or more metallic salts of unsaturated fatty acids or monocarboxylic acids, such as zinc, calcium, or magnesium acrylate salts, and the like. Preferred acrylates include zinc acrylate, zinc diacrylate, zinc methacrylate, and zinc dimethacrylate (ZMDA). The crosslinking agent must be present in an amount sufficient to crosslink the various chains of polybutadiene polymers and any other polymers to themselves and to each other so as to increase the rigidity of the material. The desired elastic modulus for the intermediate layer may be obtained by adjusting the amount of crosslinking by selecting a particular type or amount of crosslinking agent. This may be achieved, for example, by altering the type and amount of crosslinking agent, which method is well known to those of ordinary skill in the art. The crosslinking agent is typically added in an amount from about 1 to 50 parts per hundred of the polymer, preferably about 5 to 30 parts per hundred, and more preferably about 10 to 25 parts per hundred, of the "polymer," i.e., the polybutadiene or polymeric composite of the invention and any optional but preferred resilient or reinforcing polymer components.

One advantage of the present invention is the ability to prepare polymer composites using a reduced amount of crosslinking agent, such as zinc diacrylate, compared to conventional golf ball formation techniques. Without being bound by theory, it is believed that the inclusion of nanoparticle fillers can reduce the amount of crosslinking agent while still achieving the same degree of crosslinking. This can advantageously permit new modifications of density and materials in a golf ball.

Although not required, a free-radical initiator is preferably included in the composition and method. The free-radical initiator may be any compound or combination of compounds present in an amount sufficient to facilitate initiation of a crosslinking reaction between a crosslinking agent and the polybutadiene component and any other polymers present. The free-radical initiator is preferably a peroxide. Suitable free-radical initiators include di(2-t-butyl-peroxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate on calcium silicate, lauroyl peroxide, benzoyl peroxide, t-butyl hydroperoxide, and the like. The free-radical initiator is preferably present in an amount of up to 10 parts per hundred. In one embodiment, the initiator is present in an amount of about 0.001 to 5 parts per hundred, while in another embodiment, the initiator is present in an amount of about 0.2 to 1 parts per hundred of the polymer.

The components used in forming the golf ball core in accordance with the invention may be combined by any type of mixing known to one of ordinary skill in the art. The polymer system could be combined with, for example, a dicumyl peroxide, which substantially initiates reaction at around 170° C., as the free radical initiator. Suitable types of mixing include single pass and multi-pass mixing, and the like. The optional crosslinking agent, and any other optional additives used to modify the characteristics of the golf ball center, may similarly be combined by any type of mixing. A single-pass mixing process where ingredients are added sequentially is preferred, as this type of mixing tends to increase efficiency and reduce costs for the process. Suitable mixing equipment is well known to those of ordinary skill in the art, and such equipment may include a Banbury mixer or a twin screw extruder. Conventional mixing speeds for combining compound ingredients are typically used. The speed should not be too high, as high mixing speeds tend to break down the polymers being mixed and particularly may undesirably decrease the molecular weight of the polybutadiene component of the invention or any optional additional polymer component. The speed should thus be low enough to avoid high shear, which may result in loss of desirably high molecular weight portions of polymer. Also, too high a mixing speed may undesirably result in creation of enough heat to initiate the crosslinking. The maximum suitable mixing temperature depends upon the type and amount of free-radical initiator. The mixing speed and temperature are readily determinable by one of ordinary skill in the art without undue experimentation.

Fillers added to one or more layers of the golf equipment, e.g., a golf ball, typically include processing aids or compounds to affect rheological and mixing properties, the specific gravity (i.e., density-modifying fillers), the modulus, the tear strength, reinforcement, and the like. A density-adjusting filler may be used to control the moment of inertia, and thus the initial spin rate of the ball and spin decay. Fillers are typically polymeric or inorganic in nature, and, when used, are typically present in an amount from about 0.1 to 50 weight percent of the layer or portion in which they are included. Any suitable filler available to one of ordinary skill in the art may be used. Exemplary fillers include, but are not limited to, precipitated hydrated silica; clay; talc; glass fibers; aramid fibers; mica; calcium metasilicate; barium sulfate; zinc sulfide; lithopone; silicates; silicon carbide; diatomaceous earth; carbonates such as calcium carbonate and magnesium carbonate; metals such as titanium, tungsten, aluminum, bismuth, nickel, molybdenum, iron, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; cured, ground rubber; or combinations thereof. The fillers, when used, may be present in an amount of about 0.5 to 50 weight percent of the composition. In one preferred embodiment, the filler material has a specific gravity of at least about 2.5, preferably at least about 5.

Other fillers include additive ingredients such as accelerators, e.g., tetra methylthiuram, processing aids, processing oils, plasticizers, colorants, e.g., dyes and pigments, as well as other additives well known to the ordinary-skilled artisan may also be used in the present invention in amounts sufficient to achieve the purpose for which they are typically used.

Another suitable filler is regrind that includes a controlled-isomer polybutadiene or polymeric composite of the present invention. In one embodiment, such regrind-based filler is predominantly controlled-isomer polybutadiene, while in another it is primarily polymeric composite. The regrind particles can be from about 0.1 micrometers to 1 000 micrometers.

The golf balls of the present invention, or portions thereof, can be prepared as follows. A solid spherical center including the composite of the invention, one or more additional polymer components described herein, or both, is prepared by at least one of conventional compression, injection, or transfer molding techniques. A fluid-filled center may alternatively be formed instead of a solid center. Any additionally desired center layers may then be added to the center by conventional compression or injection molding techniques, preferably in a concentric fashion to maintain a substantially spherical center.

The intermediate layer preforms may be prepared as ellipsoidal or hemispherical half-shells using conventional compression or injection molding techniques. The preferred method is to prepare two half-shells that fit around the core and merge to form the intermediate layer, or one or more layers thereof. The preforms are preferably prepared by mixing the polybutadiene component or polymeric composite of the invention and any additive polymer component, and any other desired ingredients together as discussed above. The resulting geometrical stability provides additional time for processing between preform formation and curing via compression molding. This additional time may be used to improve manufacturability, optimize production scheduling, and the like, such as by preparation and stockpiling of rigid shells to facilitate molding machine shut down for maintenance or tool changes. With enough shells stockpiled, further golf ball manufacture could be carried out even while the preform injection machine is being retooled. The mixture of polymer components, free-radical initiator, optionally a crosslinking agent, and any fillers may be extruded, calendared, or pelletized for introduction into a molding machine for preparation of the intermediate layer. Alternately, the intermediate layer can be provided by retractable pin injection molding directly onto a golf ball center or another intermediate layer, thus avoiding the need to pre-form shells. Various other methods of forming golf balls according to the present invention will be readily envisioned by one of ordinary skill in the art, particularly with reference to the various methods already described herein.

The half-shells are preferably injection molded from the mixture based on cost and speed considerations, although compression molding is also suitable. The mold is preferably maintained at a temperature below the crystalline melting temperature of the reinforced polymer component to inhibit the formed shells from altering shape due to the memory of any resilient polymer component present.

After their formation, the half-shells are assembled about the core. In accordance with the invention; the shells may be produced rapidly with injection molding. The rapid production of half-shells permits use of automated procedures for assembly about the center. During assembly about the center, when ellipsoidal half-shells are used they tend to self-orient themselves vertically when placed in hemispherical mold cups, which can reduce preparation time, cost, and defects. The assembly of the core, i.e., typically two half-shell preforms and a center, may be compression molded. When the mold halves are combined, they form a rigid, spherical cavity. Once the mold is closed, the excess material from the shell crowns is forced out of the mold cavity at the equator where the mold halves combine. The compression molding of the assembled preforms and center tends to take about 5 to 40 minutes, although times may vary depending upon the types and amounts of materials used, as will be readily determined by one of ordinary skill in the art in view of the disclosure herein. For example, a typical compression molding cycle may take 12 minutes at around 174° C. The shells are forced together by the mold and substantially cured during molding. Optionally, if additional intermediate layers are desired, e.g., having different characteristics to improve or modify the overall ball qualities, they may be provided over the first intermediate layer. Additional intermediate layers are preferably added after the previous intermediate layer is cured, although they may be added before cure of the previous layer if the pre-cured intermediate layer is rigid enough so that substantially no mixing of the layers occurs.

Any conventional material or method may be used in preparing the golf ball cover disposed over the core. For example, as is well known in the art, ionomers, balata, and urethanes are suitable golf ball cover materials. A variety of less conventional materials may also be used for the cover, e.g., thermoplastics such as ethylene- or propylene-based homopolymers and copolymers. These homopolymers and copolymers may also include functional monomers such as acrylic and methacrylic acid, fully or partially neutralized ionomers and their blends, methyl acrylate, methyl methacrylate homopolymers and copolymers, imidized amino group-containing polymers, polycarbonate, reinforced polycarbonate, reinforced polyamides, polyphenylene oxide, high impact polystyrene, polyether ketone, polysulfone, poly(phenylene sulfide), acrylonitrile-butadiene, acrylic-styrene-terephthalate, poly(ethylene terephthalate), poly(butylene terephthalate), poly(ethylene-vinyl alcohol), poly(tetrafluoroethylene), and the like. Any of these polymers or copolymers may be further reinforced by blending with a wide range of fillers, including glass fibers or spheres, or wood pulp. The selection of a suitable cover, and application thereof over the intermediate layer described herein, will be readily determinable by those of ordinary skill in the art when considering the disclosure herein. One preferred cover includes a cast, polyurethane material. In one embodiment, such a cover preferably includes at least an inner and an outer cover layer, at least one of which includes the cast polyurethane.

The resulting ball, after a suitable cover is applied by conventional techniques, exhibits improved characteristics such as the low driver spin and high coefficient of restitution desired by the vast majority of golf players. The semi-rigid shells, as a result of including the intermediate layer material according to the invention, have a substantially improved concentricity of the intermediate layer in relation to the core, and require less labor to produce. For example, the midpoint of a ball core prepared according to the invention is typically no more than about 0.5 mm from the midpoint of the golf ball center once the core has been cured to crosslink the material. One of ordinary skill in the art of golf ball manufacture, as well as the typical player, will readily recognize that more accurate centering of the ball results in more consistent results and an improved game.

When golf balls are prepared according to the invention, they typically will have dimple coverage greater than about 60 percent, preferably greater than about 65 percent, and more preferably greater than about 70 percent. The flexural modulus of the cover material on the golf balls is typically greater than about 500 psi, and is preferably from about 500 psi to 200,000 psi, preferably from about 2000 psi to 150,000 psi. The hardness of the cover material is typically from about 25 to 80 Shore D, preferably from about 30 to 78 Shore D, and more preferably from about 35 to 75 Shore D. The dynamic shear storage modulus, or storage modulus, of the cover material at about 23° C. is typically at least about 10,000 dyn/cm$^2$, preferably from about $10^4$–$10^{10}$ dyn/cm$^2$, more preferably from about $10^6$ to $10^{10}$ dyn/cm$^2$. The resultant golf balls typically have a coefficient of restitution of greater than about 0.7, preferably greater than about 0.75, and more preferably greater than about 0.78. The golf balls also typically have a compression of at least about 40, preferably from about 50 to 120, and more preferably from about 60 to 100. The specific gravity is typically from about 0.7 to 2 for the cured polybutadiene material or polymeric composite of the invention. In another embodiment, the specific gravity is from about 0.9 to 1.5 for the cured polybutadiene material or polymeric composite of the invention.

The crosslinked polymeric material of the present invention typically has an effective modulus of no greater than about 16,000 psi. In one embodiment, the effective modulus is from about 500 psi to 8,000 psi. In another embodiment, the effective modulus is from about 1,000 psi to 5,000 psi. The effective modulus is measured on solid spherical bodies, typically a golf ball, cured golf ball core, or cured golf ball center using a conventional load testing frame such as an MTS 5G from MTS Corporation of Eden Prarie, Minn. The effective elastic modulus is independent of sphere diameter and inherently includes any material property gradients within the cured sphere. Traditionally, in the golf ball art, compression values are measured with Atti or Riehle gauges or are reported as deflection values at particular loads as well as loads for particular deflection values. These methods are ambiguous since the diameter of the body greatly effects the reported value. Using the effective modulus measurement eliminates ambiguity and quantifies an inherent average material property, elastic modulus. The formula set forth in "Roark's Formula for Stress & Strain," pp. 650 (1989) provides the basis for deriving a relationship between elastic tensile modulus and the load deflection profile of a spherical body. The formula describing the load deflection response for a sphere compressed between two platens in terms of its effective elastic modulus is:

$$Y=2.08*[P^2*C_e^2/D]^{1/3}$$

Where, $$C_e=(1-\nu_p^2)/E_p+(1-\nu_s^2)/E_s$$

Y is the spheres deflection (inches)

P is the applied load (pounds)

D is the sphere diameter (inches)

$\nu_p$ is Poisson's ratio for the compressing platens (typically 0.3 for steel)

$\nu_s$ is Poisson's ratio for the sphere (typically 0.48 for elastomeric polymers)

$E_p$ is the elastic modulus for the compressing platens (typically $30\times10^6$ psi for steel)

$E_s$ is the effective elastic modulus for the sphere (psi)

The method for obtaining effective elastic modulus includes: (1) Measuring the average diameter of the sphere; (2) measuring the load deflection profile of the sphere for a deflection of at least 10 percent of the spheres diameter, where the data should contain at least 20 load and deflection data pairs equally spaced for each 0.5 percent deflection and the rate of deflection should be 25 mm per minute; and (3) a least squares numerical algorithm should be used to determine the elastic modulus for the sphere, which ensures that the above disclosed equation for load deflection provides an accurate fit to the measured data. Least squares numerical algorithms for curve fitting are commonly available and may be readily implemented by one of ordinary skill in the art. For example, Microsoft Excel® contains a solver that will readily perform the least squares function.

Additionally, the unvulcanized rubber, such as polybutadiene, in golf balls prepared according to the invention typically has a Mooney viscosity greater than about 20, preferably greater than about 30, and more preferably greater than about 40. Mooney viscosity is typically measured according to ASTM D1646-00.

Figure 2:
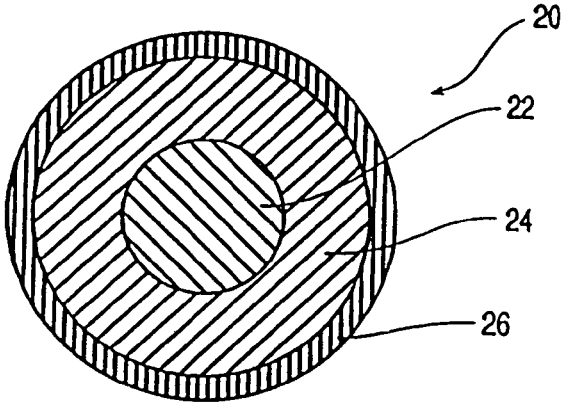
FIG. 2 illustrates a cross-section of a golf ball having an intermediate layer between a cover and a center according to the invention.
Figure 3:
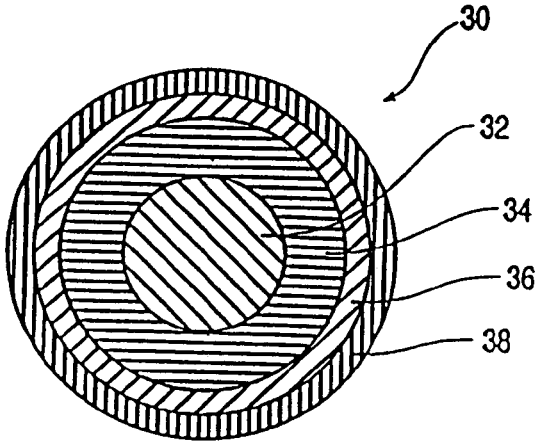
FIG. 3 illustrates a cross-section of a golf ball having more than one intermediate layer between a cover and a center according to the invention.

Referring to FIG. 1, a golf ball 10 of the present invention can include a core 12 and a cover 16 surrounding the core 12. Referring to FIG. 2, a golf ball 20 of the present invention can include a core 22, a cover 26, and at least one intermediate layer 24 disposed between the cover and the center. Each of the cover and core may include more than one layer; i.e., the golf ball can be a conventional three-piece wound ball, a two-piece ball, a ball having a multi-layer core and an intermediate layer or layers, etc. FIG. 2 illustrates a core having two layers, i.e., a center and a single intermediate layer. Referring to FIG. 3, a golf ball 30 of the present invention can include a center 32, a cover 38, and intermediate layers 34 and 36 disposed between the cover and the center. Although FIG. 3 shows only two intermediate layers, it will be appreciated that any number or type of intermediate layers may be used, as desired. FIG. 3 encompasses, for example, an one embodiment of the present invention where the center 32 is a fluid, the next outward layer is a shell 34 to contain the fluid, the next layer is an intermediate layer 36 that is either a solid or a tensioned elastomeric material, and the outermost layer is the cover 38. It should be understood that the controlled-isomer polybutadiene or polymeric composite can be included in any of the layers of these figures, or any combination of such layers.

EXAMPLES

The following examples are provided only for the purpose of illustrating the invention and are not to be construed as limiting the invention in any manner.

Examples 1–18

Blends of Cements Catalyzed with Different Catalysts and Including Nanocomposites Used to Form Polymeric Composites According to the Invention Various polymer cements can be catalyzed separately with different catalysts and combined with nanocomposites before stripping to provide a suitable polymeric composite for use in forming a portion of a golf ball according to the invention. Examples 1-18 can be prepared using relative amounts of nickel, cobalt, and neodymium catalyzed polymers noted below to provide the desired characteristics, such as molecular weight and polydispersity, in the resultant polymer cement.

| Example # | Ni-catalyzed (%) | Co-catalyzed (%) | Nd-catalyzed (%) |
|---|---|---|---|
| 1 | 90 | 10 | 0 |
| 2 | 80 | 20 | 0 |
| 3 | 70 | 20 | 10 |
| 4 | 70 | 30 | 0 |
| 5 | 60 | 10 | 30 |
| 6 | 60 | 20 | 20 |
| 7 | 60 | 30 | 10 |
| 8 | 50 | 50 | 0 |
| 9 | 40 | 50 | 10 |
| 10 | 30 | 70 | 0 |
| 11 | 30 | 40 | 30 |
| 12 | 20 | 60 | 20 |
| 13 | 20 | 20 | 60 |
| 14 | 10 | 90 | 0 |
| 15 | 10 | 40 | 50 |
| 16 | 0 | 50 | 50 |
| 17 | 0 | 90 | 10 |
| 18 | 0 | 10 | 90 |

The resultant polymer cement blend(s) can be combined and stripped to form a polymeric composite according to the present invention.

Example 19

Golf Ball Core Prepared with a Polymeric Composite of Invention

A core of a golf ball was formed using the polymeric composite according to the invention as noted in the table below.

| Formulation | Ex. 19 (phr) | Comparative Ex. (phr) |
|---|---|---|
| Cariflex BR 1220[1] | 0 | 80 |
| Kuraray TP251[2] | 0 | 20 |
| Composite Blend of Ex. 4[3] | 100 | 0 |
| Zinc diacrylate[4] | 38 | 38 |
| Zinc oxide | 5.6 | 5.6 |
| Elastoflux EF(DCP)-70[5] | 0.23 | 0.15 |
| Varox 231XL[6] | 0.63 | 0.42 |

-continued

| Formulation | Ex. 19 (phr) | Comparative Ex. (phr) |
|---|---|---|
| Physical Properties | | |
| Compression | 105 | 106 |
| COR | 0.807 | 0.790 |
| Diameter | 1.58" | 1.58" |

[1]Muehlstein, Norwalk, CT;
[2]Kuraray Co., Chuo-Ku, Tokyo Japan;
[3]Goodyear Co., Akron, OH;
[4]Sartomer Co, Exton, PA;
[5]Elastochem Inc., Chardon, OH;
[6]R. T. Vanderbilt Co., Norwalk, CT.

The polymeric composite of the invention provides improved core resilence at comparable compression.

It is to be recognized and understood that the invention is not to be limited to the exact configuration as illustrated and described herein. For example, it should be apparent that a variety of suitable materials would be suitable for use in the composition or method of making the golf balls according to the Detailed Description of the Invention. Accordingly, all expedient modifications readily attainable by one of ordinary skill in the art from the disclosure set forth herein are deemed to be within the spirit and scope of the present claims.

What is claimed is:

1. A golf ball comprising a core and a cover, wherein the core comprises a solution blended polymeric composite comprising a first polybutadiene and at least one reinforcing agent, wherein the reinforcing agent is present in an amount of about 0.1 to 1 weight percent of the composite.

2. The golf ball of claim 1, wherein the reinforcing agent comprises nanoparticles having an average size of less than about 100 nm.

3. The golf ball of claim 2, wherein the nanoparticles have an average size of about 1 nm to about 50 nm.

4. The golf ball of claim 2, wherein the nanoparticles comprise silica-based nanoparticles or carbon-based nanoparticles.

5. The golf ball of claim 1, wherein the at least one reinforcing agent is uniformly dispersed throughout the polymeric composite.

6. The golf ball of claim 1, wherein the first polybutadiene comprises about 75 percent or greater trans-isomer.

7. The golf ball of claim 1, further comprising a second polybutadiene having a cis-isomer content of about 80 percent or greater.

8. The golf ball of claim 7, wherein the first polybutadiene has a trans-isomer content of about 70 percent or greater.

9. A golf ball comprising a cover and a core, wherein at least one layer is formed from a bale of solution blended polymeric material, wherein the bale comprises a first polybutadiene and a second polybutadiene, and wherein the first polybutadiene comprises greater than about 80 percent cis-isomer and the second polybutadiene comprises at least about 70 percent trans-isomer.

10. The golf ball of claim 9, wherein the first polybutadiene comprises greater than about 90 percent trans-isomer.

11. The golf ball of claim 10, wherein the bale comprises at least about 20 percent trans-isomer and less than about 5 percent vinyl-isomer polybutadiene content.

12. The golf ball of claim 10, wherein the second polybutadiene has a trans-isomer content of at least about 80 percent.

13. The golf ball of claim 9, wherein the bale further comprises nanoparticles uniformly dispersed throughout the bale, wherein the nanoparticles have an average size of less than about 5000 nm.

14. The golf ball of claim 13, wherein the nanoparticles comprise silica-based nanoparticles or carbon-based nanoparticles.

15. The golf ball of claim 9, further comprising an intermediate layer disposed between the core and the cover, and wherein the at least one layer is the intermediate layer.

16. The golf ball of claim 13, further comprising a crosslinking agent present in an amount of about 10 to 25 parts per hundred.

17. A golf ball comprising a core and a cover, wherein the core is formed from a bale of solution blended polymeric material, wherein the bale comprises at least about 20 percent trans-isomer and:

a first polybutadiene having an uncrosslinked polydispersity of less than about 4; and a second polybutadiene.

18. The golf ball of claim 17, wherein the second polybutadiene has a trans-isomer content of at least about 70 percent.

19. The golf ball of claim 17, wherein the first polybutadiene has a polydispersity of about 2.5 or less.

20. The golf ball of claim 17, further comprising nanoparticles present in an amount of about 0.1 to 10 weight percent or less of the bale.

21. The golf ball of claim 17, wherein the crosslinking agent is present in an amount of about 10 to 25 parts per hundred.

* * * * *